US005915529A

United States Patent [19]

Popowski

[11] Patent Number: 5,915,529

[45] Date of Patent: Jun. 29, 1999

[54] JOINT GUARD

[75] Inventor: Sherry S. Popowski, Minneapolis, Minn.

[73] Assignee: Rollerblade, Inc., Eden Prairie, Minn.

[21] Appl. No.: 08/852,667

[22] Filed: May 7, 1997

[51] Int. Cl.[6] ..... A41D 13/06; A41D 13/08

[52] U.S. Cl. ..... 2/16; 2/24

[58] Field of Search ..... 2/22, 23, 24, 16; 602/26, 20

[56] References Cited

U.S. PATENT DOCUMENTS

| | | | |
|---|---|---|---|
| D. 255,728 | 7/1980 | Baron . | |
| D. 338,280 | 8/1993 | Krent et al. . | |
| D. 341,005 | 11/1993 | Pratt . | |
| D. 341,679 | 11/1993 | Levine . | |
| D. 341,681 | 11/1993 | Levine . | |
| D. 343,480 | 1/1994 | Levine . | |
| D. 346,245 | 4/1994 | Krent et al. . | |
| D. 347,301 | 5/1994 | Levine . | |
| D. 373,655 | 9/1996 | Kalvestran et al. . | |
| D. 385,670 | 10/1997 | Oetting . | |
| 1,351,731 | 9/1920 | Baldwin . | |
| 2,031,622 | 2/1936 | Walker . | |
| 2,188,718 | 1/1940 | Jung . | |
| 2,550,461 | 4/1951 | Fick . | |
| 3,416,156 | 12/1968 | Marvid . | |
| 3,463,147 | 8/1969 | Stubbs . | |
| 3,465,365 | 9/1969 | Jones et al. . | |
| 3,735,419 | 5/1973 | Byrd | 2/22 |
| 3,945,047 | 3/1976 | Jarrell, Jr. . | |
| 4,151,614 | 5/1979 | Rhee . | |
| 4,484,361 | 11/1984 | Leighton et al. . | |
| 4,490,855 | 1/1985 | Figgie, III et al. . | |
| 4,593,416 | 6/1986 | Figgie, III et al. . | |
| 4,599,747 | 7/1986 | Robinson . | |
| 4,599,748 | 7/1986 | Garcia . | |
| 4,627,108 | 12/1986 | Järvinen . | |
| 4,633,529 | 1/1987 | Litz . | |
| 4,685,153 | 8/1987 | Sims . | |
| 4,692,946 | 9/1987 | Jurga . | |
| 4,751,748 | 6/1988 | Ekins . | |

(List continued on next page.)

FOREIGN PATENT DOCUMENTS

| | | | |
|---|---|---|---|
| 967302 | 5/1975 | Canada . | |
| 440367 | 12/1935 | United Kingdom . | |
| 519043 | 3/1940 | United Kingdom | 2/24 |
| 623172 | 5/1949 | United Kingdom | 2/24 |
| 2 073 009 | 10/1981 | United Kingdom . | |

OTHER PUBLICATIONS

"Fall 1992 Rollerblade®" catalog, ©1992 Rollerblade, Inc. (15 pages).

1994 Franklin catalog (5 pages).

"The 1995 Pro Designed Product Catalog & Review", Pro Designed, Houston Texas (7 pages).

"Fall 1992 Accessories Worksheet". Rollerblade, Inc. (10 pages).

"Fall 1992 Rollerblade®" catalog, ©1992 Rollerblade, Inc. (color, 14 pages).

"1994 Franklin Catalog", (1 page).

*Primary Examiner*—Michael A. Neas

*Attorney, Agent, or Firm*—Merchant, Gould Smith, Edell, Welter & Schmidt, P.A.

[57] ABSTRACT

A joint guard for a knee or elbow joint as a flexible cushioned pad positioned over the front of the joint and sized with upper and lower portions extending around the sides of upper and lower limbs joined at the joint. Upper and lower strap fasteners permit a user to adjust the degree of attachment of the upper and lower portions of the pad to the upper and lower limbs. An abrasion resistant shield includes an upper portion secured to the upper pad portion. The shield further has a lower portion secured to the lower pad portion. The shield has a flexible plate extending from the upper portion to the lower shield portion with the plate being disconnected from the pad.

16 Claims, 2 Drawing Sheets

U.S. PATENT DOCUMENTS

| | | | |
|---|---|---|---|
| 4,796,303 | 1/1989 | Atwater . | |
| 4,884,561 | 12/1989 | Letson, Sr. . | |
| 4,888,826 | 12/1989 | Parsons, Jr. et al. . | |
| 4,914,753 | 4/1990 | Chang . | |
| 4,926,501 | 5/1990 | Goosen . | |
| 4,953,569 | 9/1990 | Lonardo . | |
| 4,986,263 | 1/1991 | Dickerson et al. . | |
| 4,999,847 | 3/1991 | Barcelo . | |
| 5,016,621 | 5/1991 | Bender . | |
| 5,024,216 | 6/1991 | Shiono . | |
| 5,065,457 | 11/1991 | Henson . | |
| 5,255,391 | 10/1993 | Levine . | |
| 5,309,570 | 5/1994 | Grimm | 2/24 |
| 5,450,625 | 9/1995 | Hu | 2/16 |
| 5,472,413 | 12/1995 | Detty . | |
| 5,477,559 | 12/1995 | Clement | 2/22 |
| 5,500,955 | 3/1996 | Gongea . | |

JOINT GUARD

BACKGROUND OF THE INVENTION

1. Field of the Invention

This invention pertains to protective wear for use in activities such as in-line skating or the like. More particularly, this invention pertains to a joint guard for protecting a knee or an elbow of a user during such activities.

2. Description of the Prior Art

In-line skating has become very popular. In order to protect a skater from injuries resulting from falls, skaters typically wear protective gear such as helmets, knee guards, elbow guards and wrist guards.

Knee and elbow guards perform a similar purpose of protecting the knee and elbow from impact or abrasion in the event of a fall. Numerous designs of elbow guards and knee guards are available. However, many such designs are cumbersome to the user and uncomfortable to wear. Further, such knee and elbow guards are typically dedicated to use on either the left or right joints of the user. Namely, a knee guard designed for use on the right knee of the user cannot comfortably be used on the left knee of the user. The absence of interchangeability between the left and the right joints is particularly frustrating for children who may frequently attempt to wear the joint guard on the wrong joint. Where joint guards are uncomfortable or awkward to put on or use, a skater may, out of frustration, elect not to wear a joint guard.

It is an object of the present invention to provide a joint guard which is comfortable to wear and easy to use. It is a further object of the present invention to provided such a joint guard which is interchangeable for use on either the right and left joints of the user.

SUMMARY OF THE INVENTION

According to a preferred embodiment of the present invention, a joint guard for a human joint such as a knee or elbow includes a flexible cushioned pad sized to be disposed over the front side of the joint with an upper portion of the pad overlying an upper limb and with a lower portion of the pad overlying a lower limb and with the pad at least partially wrapping around left and right sides of the joint. A first adjustable strap is secured to the upper portion for wrapping around a rear side of the upper limb and a second adjustable strap is provided for wrapping around the rear side of the lower limb. An abrasion resistant shield includes an upper portion secured to the pad upper portion. The shield further includes a lower shield portion secured to the pad lower portion. The shield includes a flexible plate extending from the upper shield portion to the lower shield portion with the plate being disconnected from the pad.

DESCRIPTION OF THE PREFERRED EMBODIMENT

Figure 2:
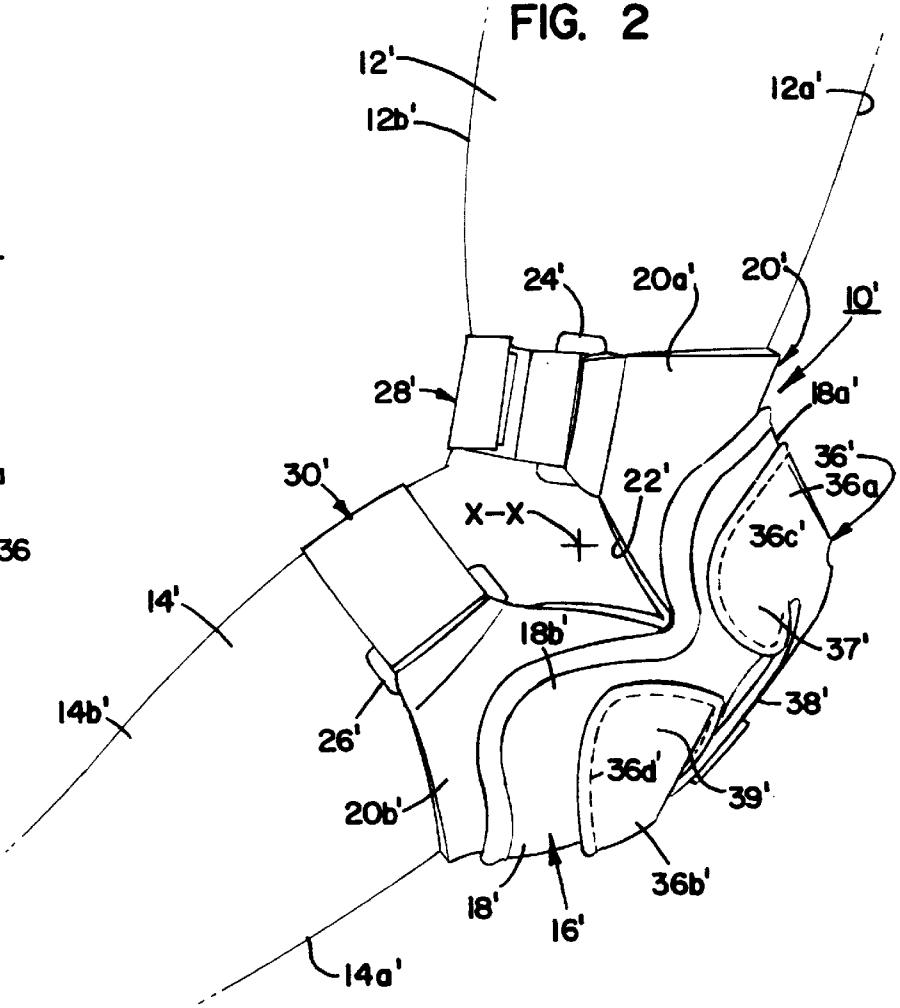
FIG. 2 is the view of FIG. 1 showing the joint guard in use on a wearer's elbow.
Figure 1:
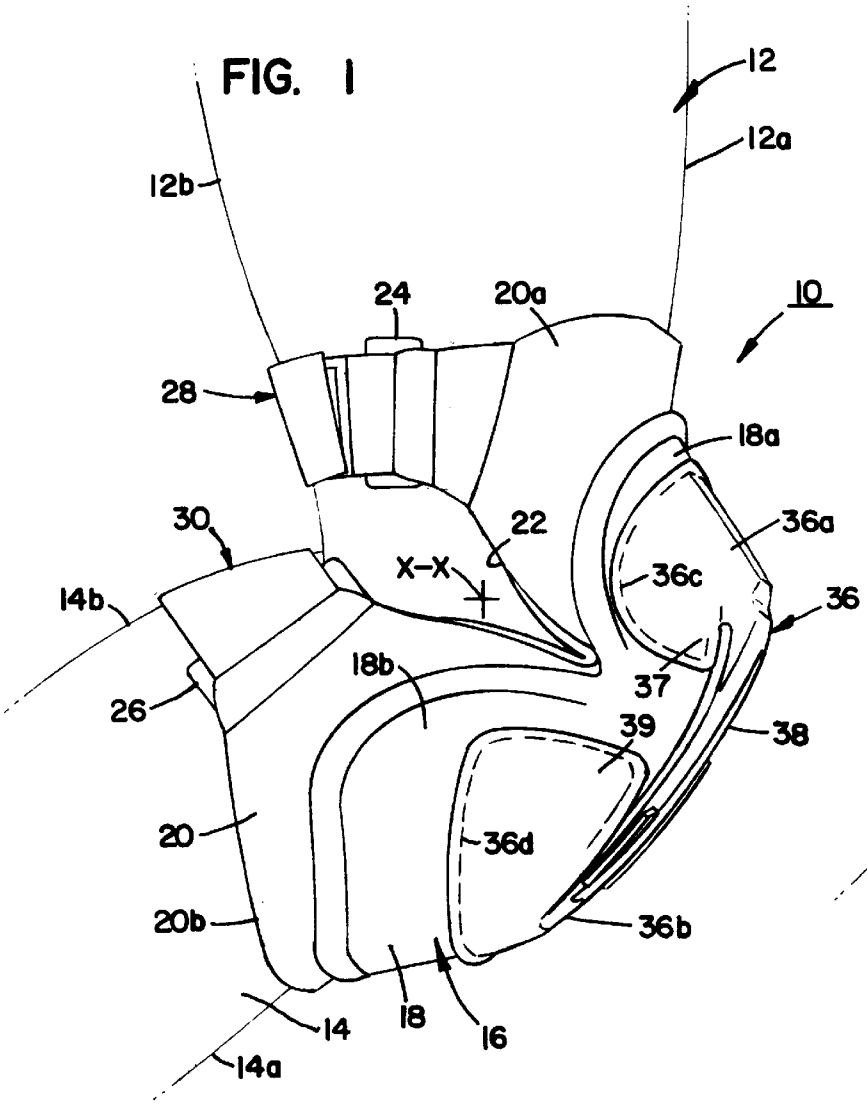
FIG. 1 is a side elevation view of a joint guard according to the present invention shown in use on a wearer's knee.

Referring now to several drawing figures in which identical elements are numbered identically throughout, a joint guard 10 according the present invention is shown. FIG. 1 illustrates a knee guard 10 in use on a human knee. FIG. 2 illustrates an elbow guard 10' of identical construction to the knee guard 10. The elbow guard 10' is shown in use on a human elbow. The elbow guard 10' is proportionately smaller than the knee guard 10, since the elbow is a smaller joint. Elements identical between FIGS. 1 and FIGS. 2 are numbered identically with the addition of an apostrophe in FIG. 2 to distinguish between the embodiments.

In FIG. 1, the joint guard 10 is shown in use on a human joint between an upper limb 12 and a lower limb 14 which pivot about a pivot axis X—X. At full extension, the joints 12, 14 are disposed in linear alignment. The limbs 12, 14 pivot about the axis X—X rearwardly to define an angle between the rear sides 12*b*, 14*b* of the limbs 12, 14.

Figure 4:
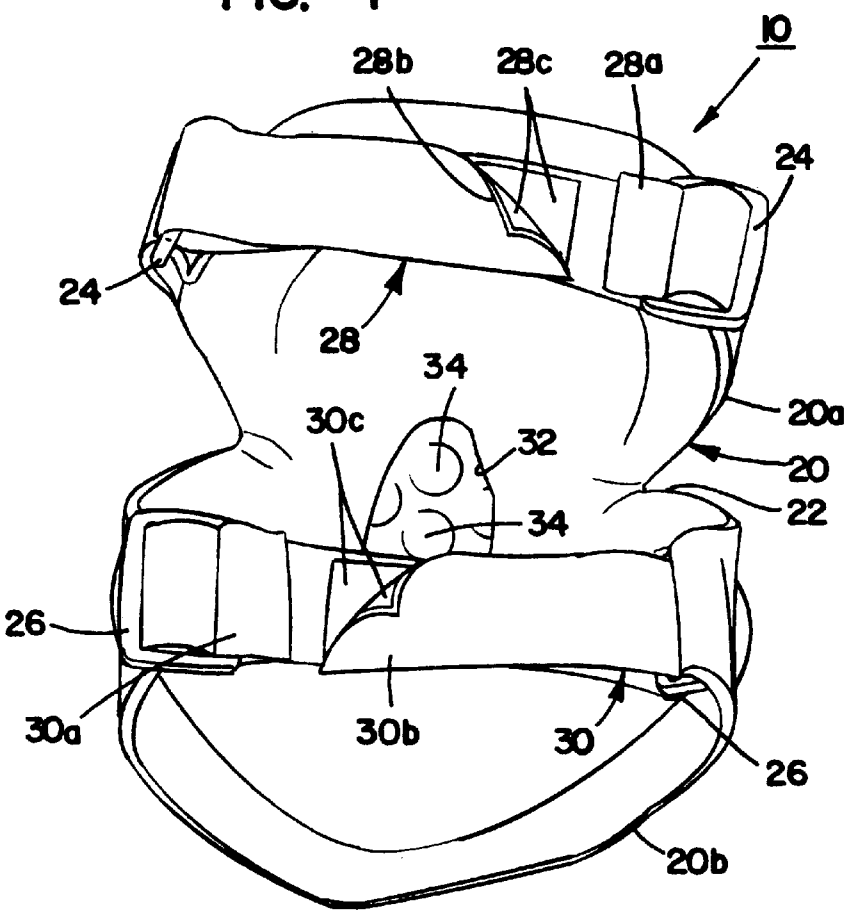
FIG. 4 is a rear elevation view of the joint guard of FIG. 1.

The knee guard 10 includes a flexible cushioned pad 16. The pad 16 includes an outer portion 18 and an inner portion 20. The pad inner portion 20 includes a centrally positioned cutout 32 (FIG. 4) positioned to be disposed over the protruding joint bone (i.e., the knee cap or the protruding elbow bone) on the front of the joint.

The inner portion 20 is a stretchable cushioned material having an upper portion 20*a* and a lower portion 20*b*. The upper portion 20*a* is sized to cover the front 12*a* of the upper limb 12 adjacent the joint and wrap partially around the sides of the upper limb 12. Similarly, the lower portion 20*b* is sized to cover the front 14*a* of the lower limb 14 adjacent the joint and wrap partially around the sides of the lower limb 14. A slit 22 is formed between the upper and lower portions 20*a*, 20*b* to permit flexing of the guard 10 as the limbs 12, 14 are pivoted about the axis X—X.

Both of the upper and lower portions 20*a*, 20*b* include rings 24, 26 on opposite sides of the upper and lower portions 20*a*, 20*b*. A first strap 28 joins the rings 24. A second strap 30 joins the rings 26. The straps 28, 30 are adjustable in size to wrap around the rear sides 12*b*, 14*b* of the limbs 12, 14 to permit a user to snugly secure the upper and lower portions 20*a*, 20*b* to the upper and lower limbs 12, 14. Each of straps 28, 30 includes a first end 28*a*, 30*a* secured to rings 24, 26 with a free end 28*b*, 30*b* passed through the opposite of the rings 24, 26 such that the straps fold over onto themselves. Opposing surfaces of the straps 28, 30 are provided with hook and loop fasteners 28*c*, 30*c* to secure the straps 28, 30.

The outer pad portion 18 likewise includes an upper portion 18*a* and lower portion 18*b* sized to cover the front 12*a*, 14*a* of the upper limb 12 and lower limb 14, respectively. The outer pad portion 18 is preferably a molded pad which is fabric covered and on its inner surface includes molded domes 34 (FIG. 4) such that the molded domes act as spacers to permit air circulation. The portions 18*a*, 18*b* are stitched to the portions 20*a*, 20*b*, but unstitched at the apex of the slot 22. Only the periphery of the portions 18*a*, 18*b* are stitched to the portions 20*a*, 20*b*.

The joint guard 10 further includes an abrasion resistant shield 36 having an upper portion 36*a* and a lower portion 36*b*. The upper portion 36*a* and lower portion 36*b* have their peripheries stitched to the upper and lower portions 18*a*, 18*b*, respectively, of the pad outer portion 18. The stitching is illustrated by stitch lines 36*c*, 36*d*.

The upper and lower portions 36*a*, 36*b* are joined by a centrally extending plate 38. Preferably, the plate 38 and upper and lower portions 36*a*, 36*b* are formed of unitary construction.

The plate 38 is approximate the width of the central protruding bone of the joint to be covered (i.e., the knee cap or the protruding elbow bone) with the plate 38 being disconnected (i.e., not stitched or otherwise directly fastened to) the outer pad portion 18. The plate 38 acts as a shield to protect the protruding bone at the center of the joint and further acts as a hinge member to couple the portions 36*a*, 36*b* while permitting articulation between the portions 36*a*, 36*b*.

The portions 36*a*, 36*b* include side portions 37, 39, respectively, which protrude outwardly from the plate 38 and inwardly towards the pivot axis of the joint. The outward projection of the plates 37, 39 is sized for the plates 37, 39 to cover and protect bony protrusions on the sides of the joint. Opposing side edges 37*a*, 39*a* of the side portions 37, 39 oppose the side edges of the plate 38 and are spaced therefrom. The side edges 37*a*, 39*a* are stitched to the outer pad 18 while the opposing edges of the plate 38 are not stitched to the pad 18.

Figure 3:
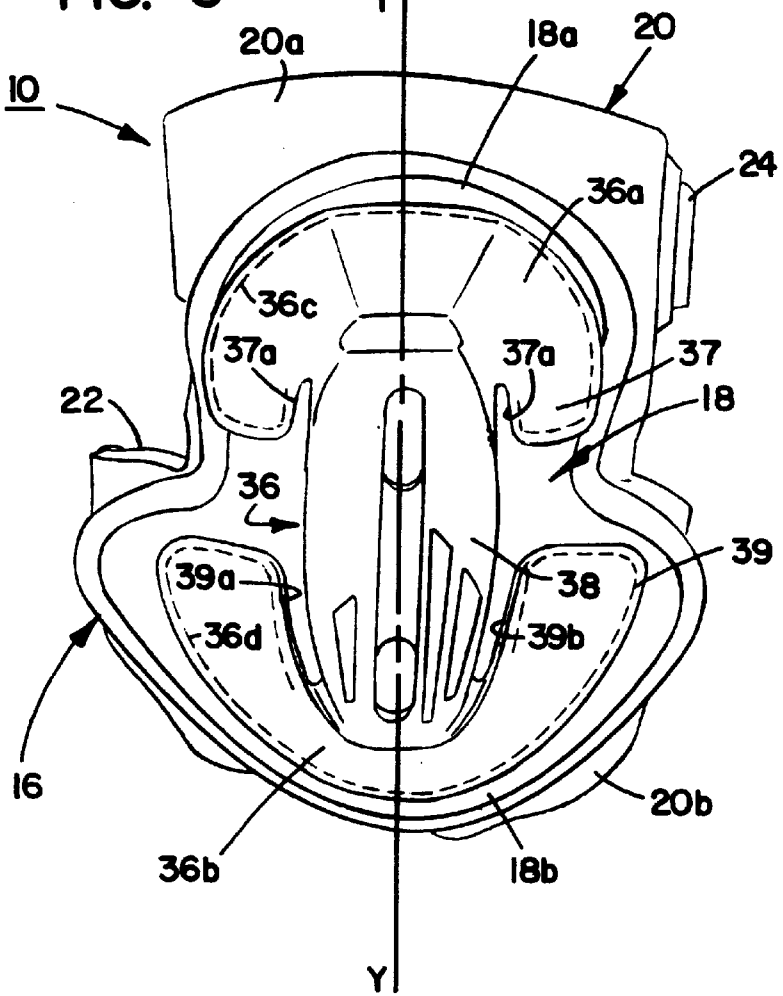
FIG. 3 is a front elevation view of the joint guard of FIG. 1.

As shown in FIG. 3, both the pad 16 and shield 36 are symmetrical about a longitudinal axis Y—Y. As a result of this symmetry, the same guard 10 may be worn on either a left joint or a right joint with equal application and ease of use.

From the foregoing detailed description of the invention it has been shown that the invention has been attained in a preferred manner. Modifications and equivalence of the disclosed concepts such as those which readily occurred to one skilled in the art are intended to be included in the scope of the claims which are appended hereto.

We claim:

1. A joint guard for a human joint such as a knee and an elbow having an upper limb and a lower limb hinged at a pivot axis transverse to said limbs and extending from a right side to a left side and dividing said joint into a front side and a rear side with said limbs pivoting relative to one another between a fully extended position with said limbs generally linearly aligned and a pivoted position with said limbs defining an angle at said rear side, said joint guard comprising:

a flexible, cushioned pad having an outer surface and an inner surface, said pad sized for said inner surface to be disposed over said front side of said joint with an upper portion of said pad overlying said upper limb adjacent said joint and said pad having a lower portion overlying said lower limb adjacent said joint and with said pad at least partially wrapping around said left and right sides;

a fastener including an adjustable upper strap secured to said upper portion for wrapping around said rear side of said upper limb and an adjustable lower strap secured to said lower portion for wrapping around said rear side of said lower limb; and an abrasion resistant shield having an upper portion secured to said pad upper portion, said shield further having a lower portion secured to said pad lower portion, said upper and lower shield portions having opposing ends defining a space therebetween:

said shield further having a flexible plate extending from said upper shield portion to said lower shield portion with said plate being disconnected from said pad, said flexible plate positioned at least partially within a portion of said space.

2. A joint guard according to claim 1 wherein said pad and shield have a common longitudinal axis extending from said upper portions to said lower portions with said pad and shield being symmetrical about said longitudinal axis.

3. A joint guard according to claim 1 wherein said pad upper and lower portions include side portions spaced from and opposing side edges of said plate.

4. The joint guard according to claim 1 wherein said upper shield portion, said lower shield portion and said plate are constructed as a unitary member without having any overlapping segments.

5. A joint guard for a human joint such as a knee and an elbow having an upper limb and a lower limb hinged at a pivot axis transverse to said limbs and extending from a right side to a left side and dividing said joint into a front side and a rear side with said limbs pivoting relative to one another between a fully extended position with said limbs generally linearly aligned and a pivoted position with said limbs defining an angle at said rear side, said joint guard comprising:

a flexible, cushioned pad having an outer surface and an inner surface, said pad sized for said inner surface to be disposed over said front side of said joint with an upper portion of said pad overlying said upper limb adjacent said joint and said pad having a lower portion overlying said lower limb adjacent said joint and with said pad at least partially wrapping around said left and right sides;

a fastener including an adjustable upper strap secured to said upper portion for wrapping around said rear side of said upper limb and an adjustable lower strap secured to said lower portion for wrapping around said rear side of said lower limb; and an abrasion resistant shield having an upper portion secured to said pad upper portion, said shield further having a lower portion secured to said pad lower portion, said shield further having a flexible plate extending from said upper shield portion to said lower shield portion with said plate being disconnected from said pad;

wherein said upper shield portion, said lower shield portion and said plate are constructed as a unitary member without having any overlapping segments.

6. The joint guard according to claim 5 wherein said upper and lower shield portions have opposing ends defining a space therebetween, said plate at least partially positioned within a portion of said space.

7. A joint guard according to claim 5 wherein said pad and shield have a common longitudinal axis extending from said upper portions to said lower portions with said pad and shield being symmetrical about said longitudinal axis.

8. A joint guard according to claim 5 wherein said pad upper and lower portions include side projections having inner edges opposing side edges of said plate and defining respective spaces therebetween.

9. A joint guard for a human joint such as a knee and an elbow having an upper limb and a lower limb hinged at a pivot axis transverse to said limbs and extending from a right side to a left side and dividing said joint into a front side and a rear side with said limbs pivoting relative to one another between a fully extended position with said limbs generally linearly aligned and a pivoted position with said limbs defining an angle at said rear side, said joint guard comprising:

a flexible, cushioned pad having an outer surface and an inner surface, said pad sized for said inner surface to be disposed over said front side of said joint with an upper portion of said pad overlying said upper limb adjacent said joint and said pad having a lower portion overlying said lower limb adjacent said joint and with said pad at least partially wrapping around said left and right sides;

a fastener including an adjustable upper strap secured to said upper portion for wrapping around said rear side of said upper limb and an adjustable lower strap secured to said lower portion for wrapping around said rear side of said lower limb; and an abrasion resistant shield having an upper portion secured to said pad upper portion, said shield further having a lower portion secured to said pad lower portion, said shield further having a flexible plate extending from said upper shield portion to said lower shield portion with said plate being disconnected from said pad; and each of said upper and lower shield portions including side projections having inner edges opposing outer side edges of said plate and defining respective spaces therebetween.

10. The joint guard according to claim 9 wherein said upper and lower shield portions have opposing ends defining a space therebetween, said plate at least partially positioned within a portion of said space.

11. A joint guard according to claim 9 wherein said pad and shield have a common longitudinal axis extending from said upper portions to said lower portions with said pad and shield being symmetrical about said longitudinal axis.

12. The joint guard according to claim 9 wherein said upper shield portion, said lower shield portion and said plate are constructed as a unitary member without having any overlapping segments.

13. A joint guard for a human joint such as a knee and an elbow having an upper limb and a lower limb hinged at a pivot axis transverse to said limbs and extending from a right side to a left side and dividing said joint into a front side and a rear side with said limbs pivoting relative to one another between a fully extended position with said limbs generally linearly aligned and a pivoted position with said limbs defining an angle at said rear side, said joint guard comprising:

a flexible, cushioned pad having an outer surface and an inner surface, said pad sized for said inner surface to be disposed over said front side of said joint with an upper portion of said pad overlying said upper limb adjacent said joint and said pad having a lower portion overlying said lower limb adjacent said joint and with said pad at least partially wrapping around said left and right sides;

a fastener including an adjustable upper strap secured to said upper portion for wrapping around said rear side of said upper limb and an adjustable lower strap secured to said lower portion for wrapping around said rear side of said lower limb; and an abrasion resistant shield having an upper portion secured to said pad upper portion, said shield further having a lower portion secured to said pad lower portion, said shield further having a flexible plate extending from said upper shield portion to said lower shield portion, said upper and lower shield portions having opposing ends defining a space therebetween with said plate at least partially positioned within a portion of said space and with said space being sized to prevent engagement of said upper shield portion and said lower shield portion; and each of said upper and lower shield portions including longitudinally extending side projections having inner edges opposing outer side edges of said plate and defining respective spaces therebetween.

14. A joint guard according to claim 13 wherein said pad and shield have a common longitudinal axis extending from said upper portions to said lower portions with said pad and shield being symmetrical about said longitudinal axis.

15. The joint guard according to claim 13 wherein said upper shield portion, said lower shield portion and said plate are constructed as a unitary member without having any overlapping segments.

16. The joint guard according to claim 13 wherein said plate is disconnected from said pad.

* * * * *